US005300953A

United States Patent [19]

Schulte

[11] Patent Number: 5,300,953

[45] Date of Patent: Apr. 5, 1994

[54] THERMAL RIBBON CASSETTE TENSION CONTROL FOR A THERMAL POSTAGE METER

[75] Inventor: Robert B. Schulte, Springboro, Ohio

[73] Assignee: Pitney Bowes Inc., Stamford, Conn.

[21] Appl. No.: 949,942

[22] Filed: Sep. 24, 1992

[51] Int. Cl.[5] ..... B41J 33/36

[52] U.S. Cl. ..... 346/76 PH; 400/234

[58] Field of Search ..... 400/120, 234; 346/76 PH

[56] References Cited

U.S. PATENT DOCUMENTS 4,739,343 4/1988 Dolan ..... 346/76 PH 4,746,234 5/1988 Harry ..... 400/120

*Primary Examiner*—Benjamin R. Fuller

*Assistant Examiner*—Huan Tran

*Attorney, Agent, or Firm*—Charles G. Parks, Jr.; Melvin J. Scolnick

[57] ABSTRACT

An improved thermal printing postage meter includes a base supporting a registration wall and a deck. A thermal print head is fixably mounted to the registration wall above a portion of the deck to define a print station. A thermal ribbon cassette is detachably mounted to the registration wall, the thermal ribbon cassette having a thermal transfer ribbon supply mounted around a supply roller and threaded past the print head in the printing station to a take-up roller. A platen roller assembly supports a platen roller for positioning the platen roller to assume a second position biasing the media against the thermal ribbon and the thermal print head. A first motor drive is provided for rotatively driving the platen roller, wherein rotation of the platen roller simultaneously drives the media and thermal ribbon past the print head. A second motor drive is provided for driving the take-up roller during a print cycle. A microcontroller communicates with the first drive motor and the second drive motor for driving the first and second motor drives at complementary speeds such that the take-up side web tension of the thermal ribbon within the thermal cassette remains constant.

3 Claims, 6 Drawing Sheets

THERMAL RIBBON CASSETTE TENSION CONTROL FOR A THERMAL POSTAGE METER

BACKGROUND OF THE INVENTION

The present invention relates to thermal printing devices and, more particularly, to a method for controlling the take-up ribbon tension of the thermal ribbon cassette.

In the development of a novel thermal printing postage meter consideration was given to utilizing a replaceable thermal transfer ribbon cassette. In utilizing a thermal transfer ribbon cassette in combination with the novel thermal printing postage meter, it is considered advantageous to utilize a postage meter configuration whereby a driven platen would be singularly responsible for displacement the print media, i.e., envelope, and the thermal transfer ribbon in order to insure synchronized printing. In order to further insure print quality, it is considered advantageous to maintain a constant print ribbon tension during the printing cycle.

Conventionally, tension control is provided by a clutched take-up system. However, due to the constantly changing radius of the take-up spool, a fixed input clutch produces a high web tension in the beginning of the cassette tape and a low web tension at the end of the cassette tape. It is further noted that the ribbon once partly relieved of transfer ink due to the printing process is difficult to wind uniformly on the take-up spool. After the printing process that portion of the spent transfer ribbon is severely weakened and distorted due to the printing process, too much web tension can cause induced wrinkles in the printing area as well as uneven winding on the take-up spool resulting in an overly large take-up spool diameter which may also be the result of too low web tension.

For postage meter application, it is a fur advantage to utilize a compact ribbon in order to maximum use of the web ink area which requires overlapping of the supply side and take-up side radii. As a result, it is important that the take-up spool wind properly to avoid collision between the supply side radius and the take-up side radius.

SUMMARY OF THE INVENTION

It is an objective of the present invention to present a method and apparatus for maintaining desired web tension of the thermal ink transfer ribbon of a thermal ribbon cassette.

It is a further objective of the present invention to present a method and apparatus for maintaining desired web tension of the thermal ink transfer ribbon of a thermal ink transfer tape cassette.

It is a still further objective of the present invention to present a method and apparatus for maintaining desired web tension of the thermal ink transfer ribbon of a thermal ink transfer ribbon cassette particularly suited for use in combination with a thermal postage meter.

A preferred thermal postage meter is comprised of a number of modules or systems. Upon the placement of an envelope on the deck of the thermal printer by an operator, the envelope encounters a position sensing assembly which includes an envelope stop arrangement. The envelope stop arrangement prevents the envelope from being longitudinally mis-positioned. Upon proper positioning of the envelope on the deck, the position sensing assembly senses the presence of the envelope and inform a microcontroller to first duck the position sensing assembly out of the way, inclusive of the stop assembly, and initiate the print sequence. Upon initiation of the print sequence, a platen roller assembly is repositioned to bring the print area of the envelope into contact with the print ribbon of a ribbon cassette. The thermal print head of the postage meter is positioned as a backing to the print ribbon. The microcontroller drives a motor which in turns drives the platen roller. Rotation of the platen roller causes the envelope and cassette print ribbon to simultaneously traverse the print head while concurrently enabling the thermal print head. Following completion of the print cycle, the microcontroller causes the platen roller to be ducked below the deck and a pressure roller to be engaged for ejection of the envelope.

The tape cassette is comprised of a cassette housing having a take-up spool driven by a ribbon motor mounted to the thermal postage meter. The ribbon motor is under the control of the microcontroller. The take-up spool has formed axial extending gear teeth and is rotatively mounted by suitable conventional means in the cassette housing to be axially aligned to an opening in the rear wall of the housing. The gear teeth of the ribbon motor drive spool are configured to be mating to axial gear teeth formed on the periphery of the ribbon take-up spool. In like manner, the cassette housing includes supply spool having axial extending gear teeth rotatively mounted to the rear wall aligned to an opening in the rear wall. The gear teeth are configured to be mating to axial gear teeth formed on the periphery of the ribbon supply spool. An encoding post is rotatively mounted in the cassette rear wall, by any suitable conventional means, having a short shaft extending through the rear wall and into the aperture in the registration wall. A gear is fixably mounted to one end of the short shaft to be in constant mesh with the gear of the encoding assembly. A plurality drag post is strategically mounted fixably by any conventional means to the cassette rear wall. The cassette housing further has a cassette opening and is mounted between upper clamp and lower clamp which extend from the registration wall.

As the partly spent transfer ribbon is driven by the thermal print head, the take-up spool is driven by the ribbon motor such that tension on the ribbon on the take-up side of the ribbon cassette remains constant. In order to accomplish this, the back EMF of the motor is monitored my the microcontroller such that variation in the back EMF of the motor is related to the ribbon tension with due compensation for changes in spool radius. The microcontroller will then adjust the motor torque to maintain the desired ribbon tension.

DETAILED DESCRIPTION OF THE PREFERRED EMBODIMENT

Figure 1:
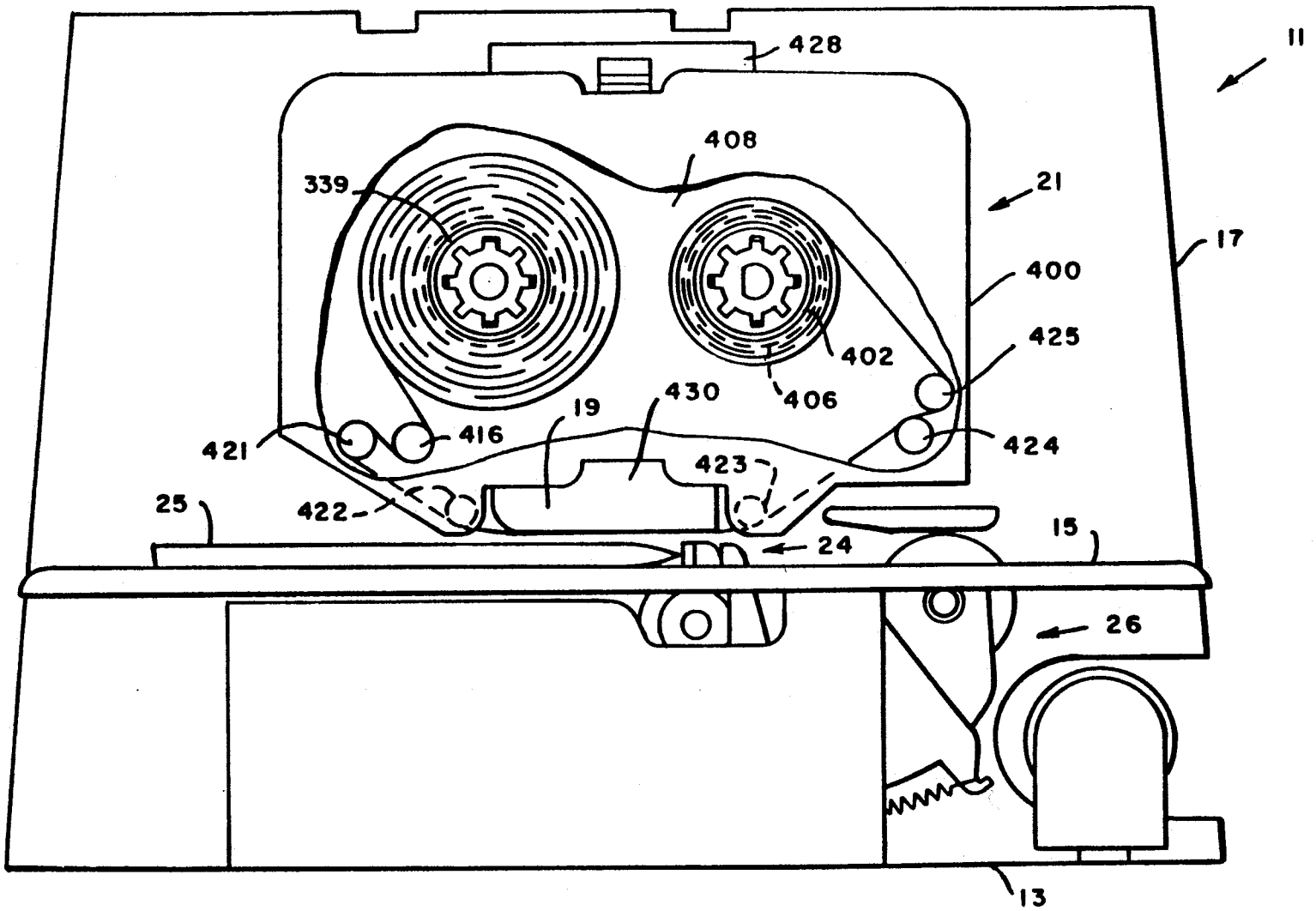
FIG. 1 is a partly section frontal view of a thermal postage meter and ribbon cassette in accordance with the present invention.

Referring to FIG. 1, a thermal postage meter generally indicated as 11, includes a base 13 which supports a deck 15. The base 13 supports a registration wall 17, by any conventional means, to extend vertically upward from the deck. A thermal print head 19 is fixably mounted, by any conventional means, to the rear registration wall 17. The rear registration wall 17 has mounted thereto a thermal ribbon cassette 21. Mounted in the base 13 is a position sensing arrangement generally indicated as 24, for sensing the position of an envelope 25 transported along the deck 15 by a platen roller assembly, generally indicated as 26.

Figure 2:
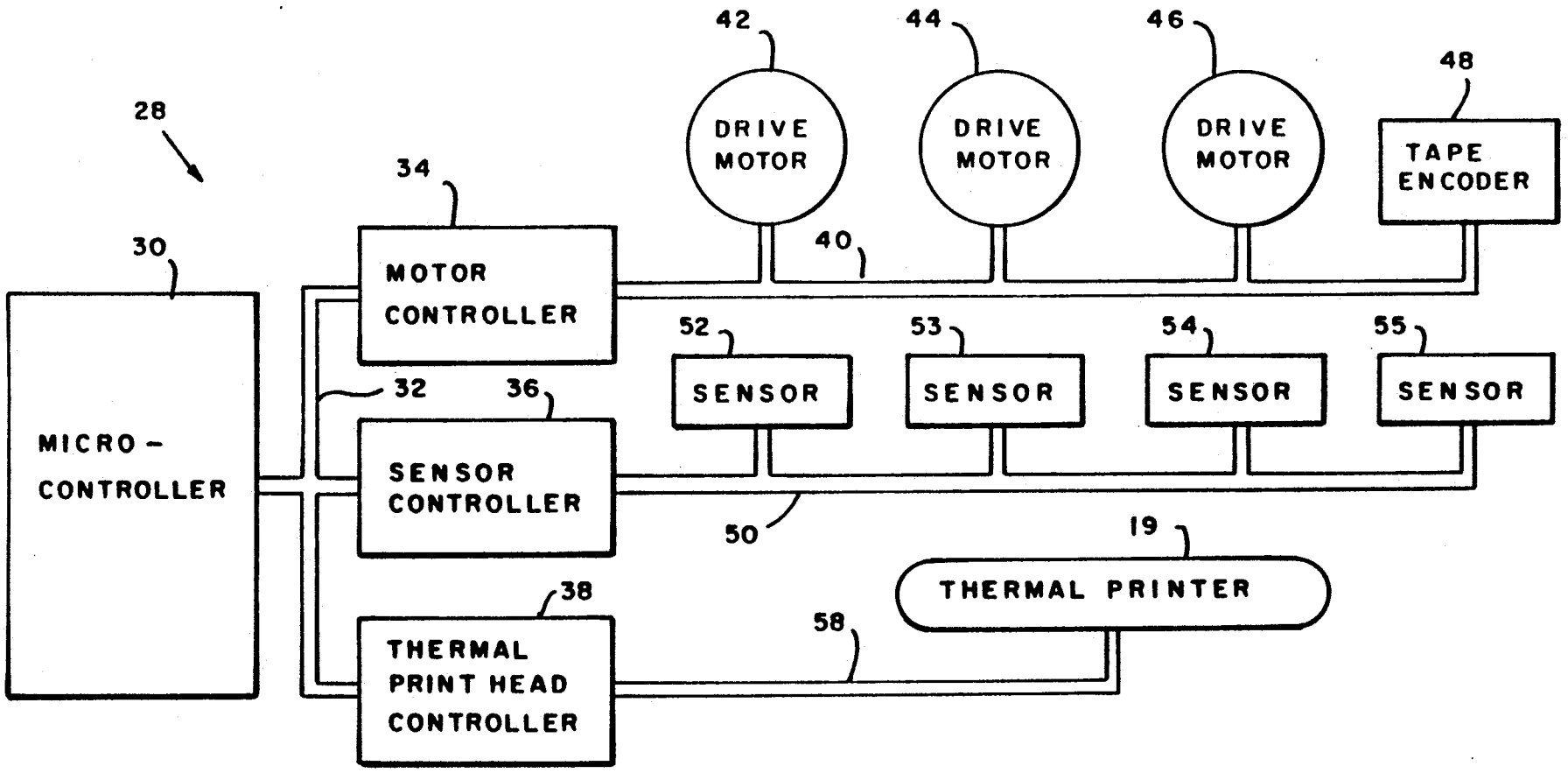
FIG. 2 is a schematic of a microcontroller in accordance with the present invention.

Referring to FIGS. 1 and 2, the thermal printing meter is under the influence of a system microcontroller, generally indicated as 28. The microcontroller system 28 is comprised of a programmable microcontroller 30 of any suitable conventional design, which is in bus 32 communication with a motor controller 34, a sensor controller 36, and the thermal print head controller 38. The motor controller 34, sensor controller 36 and thermal print head controller 38 may be of any suitable conventional design. The motor controller 34 is in motor bus 40 communication with a plurality of drive motors 42, 44 and 46. The motor control bus 40 also communicates the motor controller 34 to a ribbon encoder 48. The sensor controller 36 is in sensor bus 50 communication with a plurality of sensors 52–55 and the thermal printer controller 38 is in print head bus 58 communication with the thermal print head 19.

Figure 3:
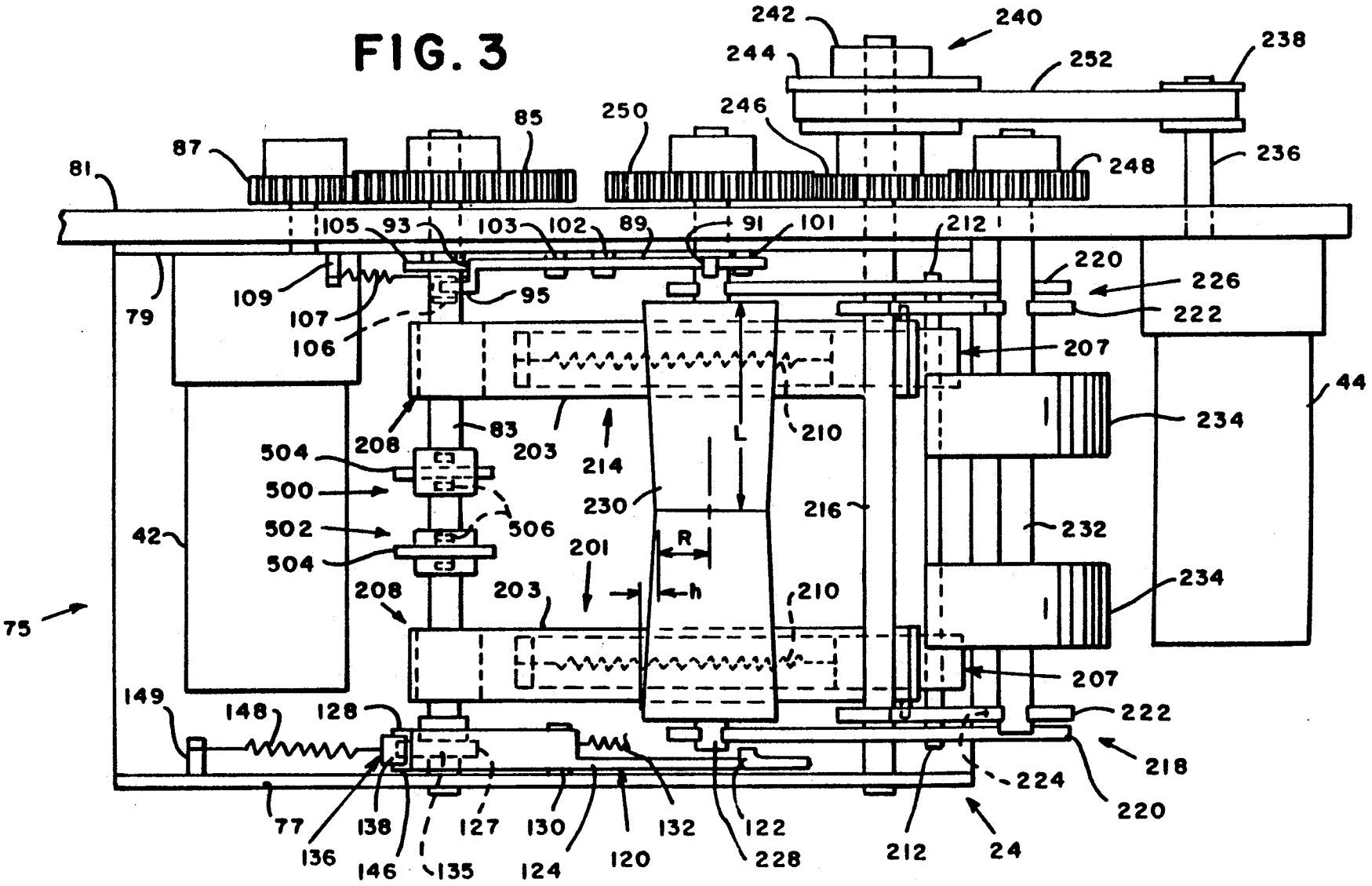
FIG. 3 is a sectioned top view of the thermal postage meter in accordance with the present invention.
Figure 4:
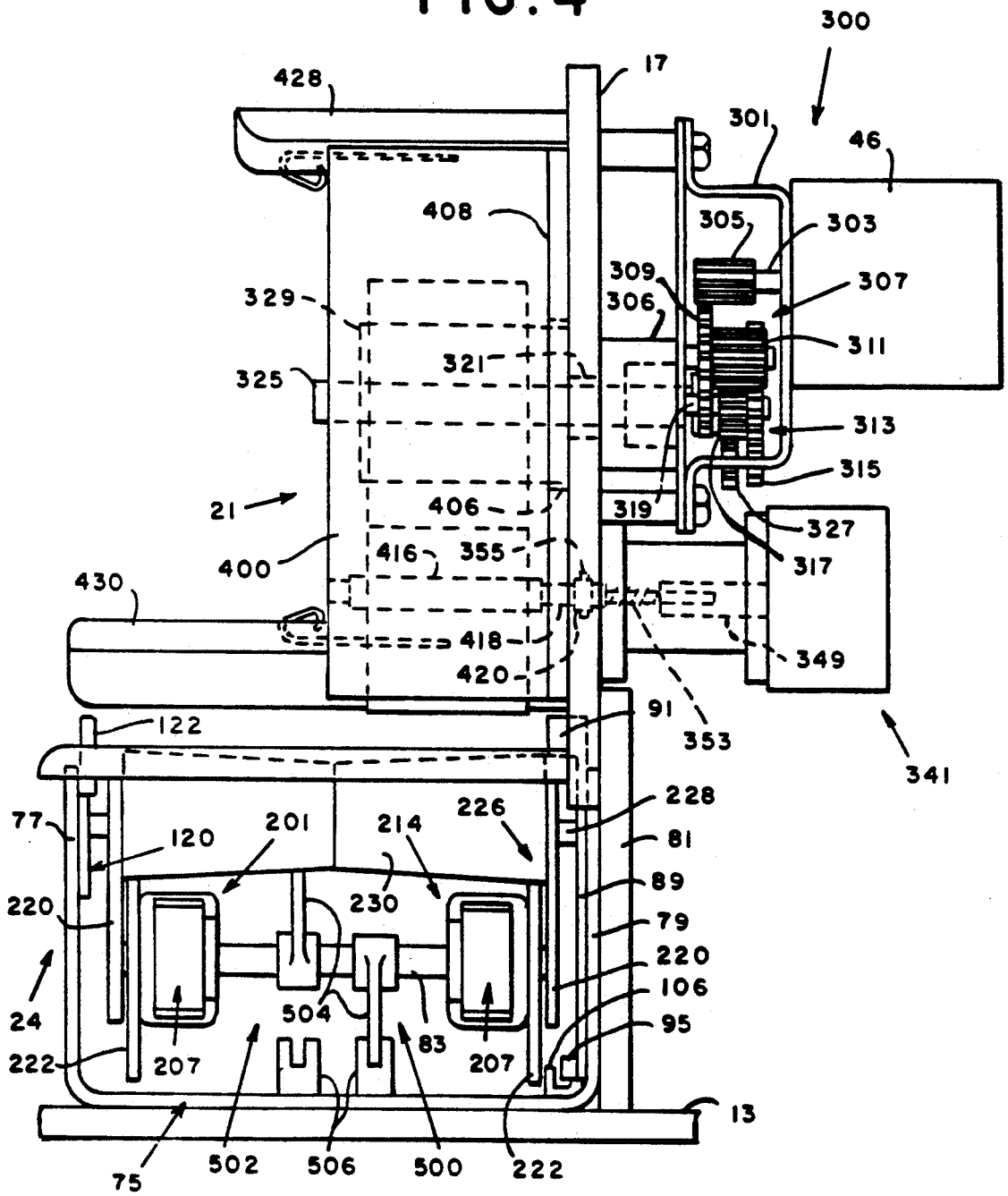
FIG. 4 is a sectioned end view of the thermal postage meter in accordance with the present invention.
Figure 5:
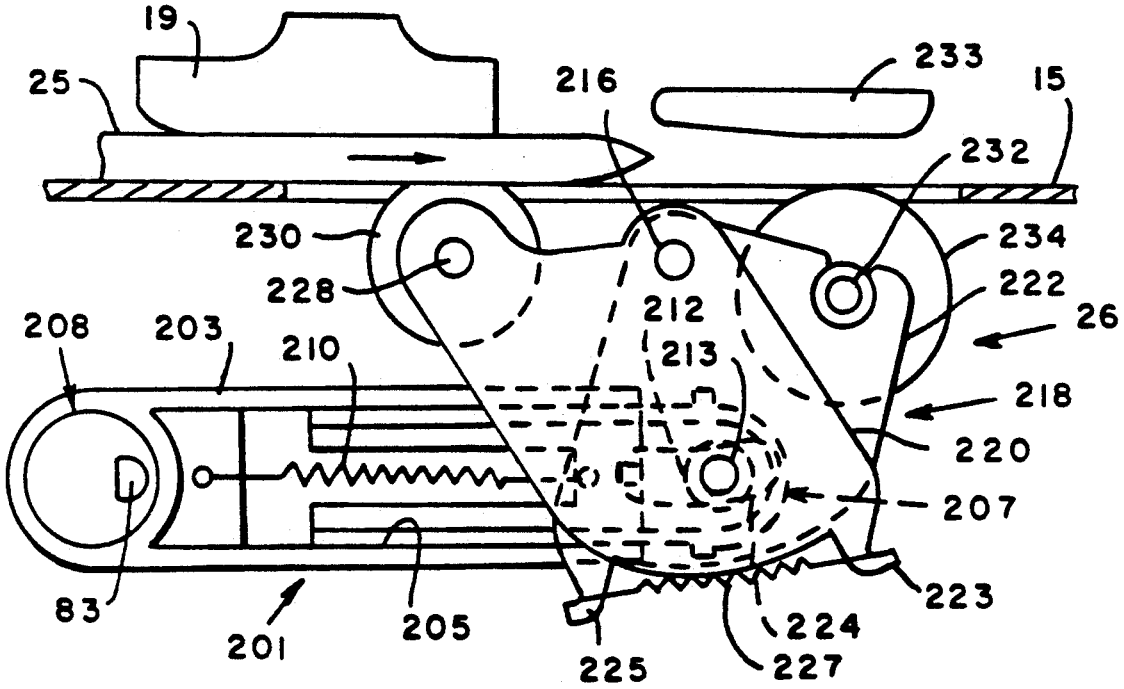
FIG. 5 is a side schematic of the platen roll and ejection roller support structure during a print cycle in accordance with the present invention.
Figure 6:
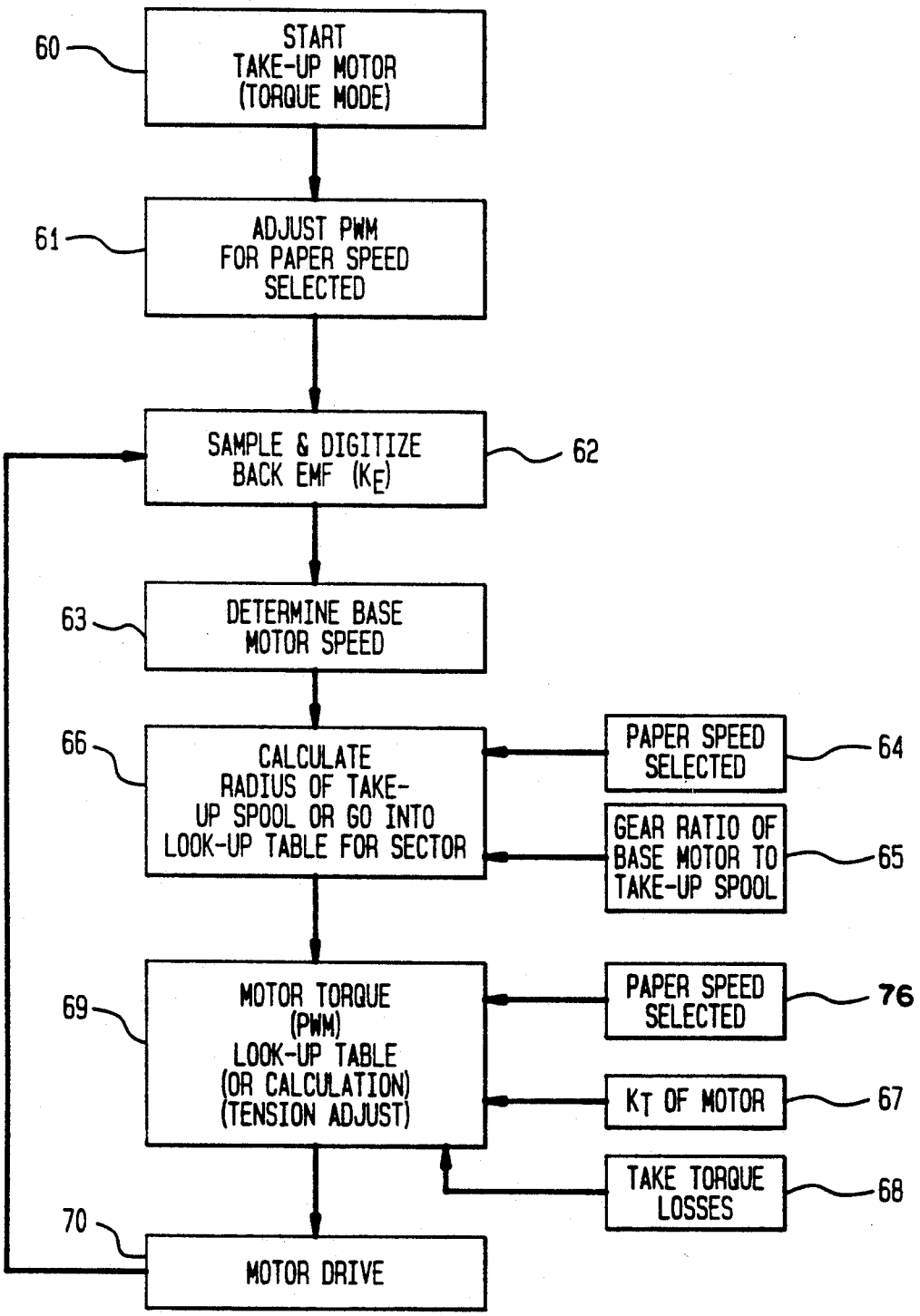
FIG. 6 is a logic diagram of the system control of the take-up motor in accordance with the present invention.

Referring to FIGS. 3 and 4, the position sensing assembly 24 is comprised of a U-shaped support bracket 75 mounted to the base 13. The U-shaped support bracket 75 has a bracket forward wall 77 and a rear wall 79. Preferably, the bracket 75 is mounted to a base support wall 81 by any conventional means. It is noted that in the subsequent description, certain specific elements are presented as part of more than one assembly.

A shaft 83 is rotatively mounted to extend between the bracket walls 77 and 79 by any conventional means such as by a bearing assembly. A drive gear 85 is fixably mounted to the shaft 83 at one end. The motor 42 has a output gear 87 which is in constant mesh with the drive gear 85 for causing the shaft 83 to rotate under the influence of the motor 42. A position lever 89 which includes a envelope facing surface 91, camming surface 93, and sensor tab 95, and further includes slots 97, 98 and 99, is slidably mounted on hubs 101, 102 and 103 formed on the rear wall 79 of the bracket 75. The position lever 89 is mounted to the rear wall 79 such that the hubs 101, 102 and 103 ride within the respective slots 97, 98 and 99. A cam 105 is eccentrically mounted to the shaft 83 such that the camming periphery of the cam 105 is opposite the camming surface 93 of the position lever 89. A spring 107 is detachably mounted to the position lever at one end and to a formed tab 109 in the rear wall 79 at the other end. The spring biases the position lever 89 such that the camming surface 93 is biased against the cam surface of cam 105.

Mounted to the forward bracket wall 77 is an envelope stop lever 120 which includes an envelope facing surface 122, channeled main section 124, a collared tab 126 mounted within the channel section 124, a cam follower surface 127 and an interlock tab 128. The stop lever 120 is pivotally mounted on a hub 130 which is formed in the forward bracket wall 77. A spring 132 which has one end attachably mounted to a tab 134 formed on the rearward bracket wall 77 and the other end attachably mounted to the collared tab 126 biases the camming surface 127 against the cam 105. A locking lever 136 which includes a locking tab 138 and 140 for securing the locking tab 128 of the envelope stop lever 20 between the locking tabs 138 and 140 of the locking lever 136. The locking lever 36 also includes a camming surface 142 opposite the cam 105 and a formed support ring 144 which is pivotally mounted to a tab 146 formed in the forward bracket wall 77. A spring 148 which is detachably mounted at one end to a tab 149 and at its other end to the envelope stop lever 120 is mounted for biasing the locking lever 136 in the direction of the cam 105.

The platen roller assembly 26 includes a linking arm assembly 201 comprising a first link section 203 having a receiving channel 205 and a second section 207 having a portion matingly received in the receiving channel 205 of the first linking section 203. One end of the first linking section 203 is eccentrically mounted around the shaft 83. A spring 210 having its respective ends detachably mounted in the first and second sections of the linking arm 203 and 207, respectively, biases the second section 207 within the receiving channel 205 of the first link section 203. The exposed end of the second section 207 includes a hub 212. A second linking arm assembly 214 is constructed identical to the linking assembly 201 and is eccentrically mounted in cooperative alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a springhook 225 is formed in the second link plate 222. A spring 227 has its respective ends fastened around the respective spring hooks 223 and 225 in a conventional manner. A second pivot link assembly 226, identical to the pivot link assembly 228, is pivotally mounted to the shaft 216 in spaced apart relationship to the pivot link assembly 218. A platen module 228 is rotatively mounted by any conventional means to the link plates 220 of the respective pivot link assemblies, 218 and 226. A platen roller 230 is fixably mounted around the platen roller shaft 228, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure rollers 234 are aligned generally opposite a backing member fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216, a spool 244 fixably mounted to the hub 242 and a gear 246 also fixably mounted to the hub 242. A gear 248 is fixably mounted to the shaft 232 and a gear 250 is fixably mounted around the shaft 228. The gears 246 is constant mesh with gear 248 and 240, and an endless belt 252 extends around the spools 238 and 244.

Referring to FIGS. 1 and 4, a thermal drive cassette assembly, generally indicated as 300, is comprised of a mounting platform 301 of any suitable construction. The mounting platform 301 is fixably mounted, by any conventional means, to the back side of the registration wall 17. A ribbon motor 46 is fixably mounted to the mounting platform 301, by any suitable conventional means. The output shaft 303 of the drive motor 46 has a drive gear 305 fixably mounted to the output shaft 303 of the drive motor 46. A conventional double gear set 307 having a first gear 309 in constant mesh with the drive gear 305 and a second gear 311 rotatively mounted to the back side of the registration wall 17. A conventional double supply gear set 313 having first gear 315 is in constant mesh with the gear 311 and a second gear 317 is rotatively mounted by any conventional means to a gear hub 319. The gear hub 319 is fixably mounted to the mounting platform 301 by any conventional means and rotatively supports the idle gear set 313 by any suitable conventional means. A registration wall aperture 312 is formed in the registration wall 17. A convention bearing hub assembly 323 is fixably mounted to the back side of the registration wall 17 aligned to the aperture 321. A ribbon drive shaft 325 extends through the aperture 321 rotatively supported by the bearing hub assembly 323. A gear 327 is fixably mounted by any conventional means to one end of the ribbon drive shaft 325 in constant mesh with the gear 317. A ribbon take-up spool 329 is fixably mounted by any conventional means around a portion of the ribbon drive shaft 325.

A ribbon supply assembly, generally indicated as 331, is mounted to the back side of the registration wall 17 aligned to a registration wall aperture 333. The ribbon supply assembly 331 includes a convention one way clutch and shaft assembly 335 of any suitable construction fixably mounted to the back side of the registration wall 17 aligned to the aperture 333. The assembly 335 includes an idle shaft 337 extending through the aperture 333. A ribbon supply spool 339 is fixably mounted by any conventional means around a portion of the shaft 337.

An encoding assembly, generally indicated as 341, is fixably mounted to a mounting spindle 343 which is fixably mounted to the back side of the registration wall 17, by any suitable conventional means, aligned to a registration wall aperture 345. The encoding assembly 341 includes collar 347 and a input shaft 349. A mating male shaft 351 is received by the shaft 349 such that the male shaft 351 can experience limited axially displacement within the shaft 349 and such that the male shaft rotatively drive the shaft 349 such as by any suitable conventional mating longitudinal gears arrangement. A spring 353 is placed around the shaft 351 and an end cap gear 355 is fixably mounted by any conventional means to the shaft 351 within the aperture 345.

The tape cassette 21 is comprised of a cassette housing 400 having a take-up spool 402. The take-up spool is driven by the shaft 325 in a conventional manner. The take-up spool 404 is rotatively mounted by suitable conventional means in the cassette housing 400. In like manner to the supply 402 the cassette housing includes supply spool 410 which is positively engaged with shaft 337, by any suitable conventional means. An encoding post 416 is rotatively mounted in the cassette rear wall 408, by any suitable conventional means, having a short shaft 418 extending through the rear wall 408 and into the aperture 345 in the registration wall 17. A gear 420 is fixably mounted to one end of the short shaft 418 to be in constant mesh with the gear 355 of the encoding assembly 341. A plurality drag post 421, 422, 423, 424 and 425 are strategically mounted fixably by any conventional means to the cassette rear wall 408. The cassette housing 400 further has a cassette opening 426 and is mounted between upper clamp 428 and lower clamp 430 which extend from the registration wall 17.

The platen roller 230 has a length 2L and a radius of R at the center. The radius of the platen roller 230 has a linear surface transition to a end radius of (R+h). In the preferred embodiment of the present invention, the platen roller is comprised of a 25 to 35 durometer cellular urethane. The preferred dimensions.

| | |
|---|---|
| Length (2L) | 3.000 inches |
| Center Radius (R) | 0.849 inches |
| End Radius (R + h) | 0.969 inches |
| Taper Angle | 3.0 degrees |

Referring to the figures, the function of the thermal postage meter 11 is to accept an envelope 25, print an indicia using thermal transfer print technology, and eject the envelope 25 from the printer. The feed direction of the printer is from left to right. The function of the platen roller roller 230 is to feed the envelope at a constant rate and to supply the print head pressure need to transfer of the thermal ink from the ribbon. As the platen 230 feeds the envelope through the print nip, it also feeds the thermal transfer ribbon. Therefore, use of the platen roller 230 for ejection would lead to wasted ribbon. A separate ejection roller 222 is used to feed the envelope out of the printer after printing.

The thermal transfer ribbon feeds around a urethane wrapped encoder roller 416 inside the cassette. As the ribbon feeds, the friction of the ribbon against the encoder roller 416 causes it to turn. The encoder roller gear 420 which protrudes from the back side of the cassette and couples with a mating gear 355 in the printer. The mating gear 355 turns an optical encoder 341 which is used to monitor ribbon motion.

The feed system consist of the platen roller 230 and ejection rollers 234. These rollers are provided with independent control of the envelope 25. They are mounted on a pivot link assembly 218 which pivots about a fixed location shaft 216. In the home position (FIG. 1), the ejection rollers 234 are above the feed deck 15 and the platen roller 230 is below the feed deck. The envelope stop lever 122 and envelope trip lever 91 are above the feed deck in the path of the envelope. The shaft 83 is positioned at 0 degrees rotation.

An envelope 25 is placed onto the feed deck 15 by the operator and inserted into the feed throat. The envelope 25 hits the stop lever 122 which is retained by a locking lever 138 and the spring loaded trip lever 89. The purpose of the stop lever 122 is to keep the envelope 25 from feeding to far through the print path and also to assure proper alignment of the envelope. The trip lever 89 signals the beginning of the print cycle. When the trip lever 89 is pushed forward about 4 mm, it unblocks an optical sensor 90 mounted to the base 75, signalling the printer through the microcontroller 30 to engage the envelope 25. As soon as the trip lever 89 signals an envelope present, the shaft 83 will begin to rotate in a clockwise direction. The shaft 83 contains 2 independent cams 135 and 105 which respectively drive the stop lever 120 and the trip lever 89 out of the feed path. The stop lever cam 135 first rotates the locking lever 136 out of the way. The shaft 83 then continues rotating to move the spring loaded stop lever 120 out of the feed path. The trip cam 105 directly drives the trip lever 89 from the patch. The levers 89 and 120 are completely out of the paper path after 180 degrees of rotation.

Concurrently, with disengagement of the levers 89 and 120, the shaft 83 rotation causes the spring loaded link 201 and 214 to move the rollers 234 out of the feed path and the platen roller 230 toward the envelope 25. The platen roller 230 continues moving toward the envelope 25 until it closes the envelope 25 between the platen roller 230 and the print head 19. Depending on the mail thickness, the platen roller 230 will meet the envelope 25 at different points in the rotation of the shaft 83. The ejection rollers 234 may still be above the feed deck. The shaft 83 will then continue to rotate, causing the links 203 and 207 of link assemblies 201 and 214 to extend and both the link extension springs 210 and the ejection springs 227 to apply a load to the envelope 25. When the shaft 83 has rotated 180 degrees, the ejection roller 234 is out of the feed path, the platen roller 230 is fully engaged, and the printer has complete control of the envelope. Printing can now begin.

As mentioned, the shaft 83 contains the link 201 and 214, the cam 105 and 135. The shaft 83 also has a set of flags to trigger when the shaft has rotated 180 degrees. The flags, generally indicated as 500 and 502, respectively, are each comprised of a interrupter 504 fixably mounted to the shaft 83 and an cooperatively aligned optical sensor 506 fixably mounted to the base 75. When the flag 500 and 502 signals the microcontroller 30 that it is time to stop the shaft rotation, the motor 42 is electronically braked.

Once the platen roller 230 has fully engaged the envelope 25, the motor 44 and the ribbon drive motor 46 are started. Note that the motor 44 turns both the platen roller 230 and the ejection rollers 234. However, the ejection roller 234 are not in the supply path so it has no affect on the envelope 25. The envelope 25 and cassette ribbon begin to feed and are brought up to speed. Printing then starts by loading data to the print head at a constant rate from the microcontroller 30 through the print head controller 38. The speed is monitored and controlled through the encoder (not shown) on the motor 44. In the preferred embodiment of the present invention, the printing operation takes about 425 mS.

While printing, the ribbon is driven through the print nip by the motion of the envelope 25. The ribbon take-up motor 46 winds up the ribbon on the take-up core and provides even tension without pulling the ribbon through the print nip. In order to provide the even tension desired, the back EMF of the motor 46 is monitored. Changes in the back EMF indicate quantity of ribbon and the ribbon drive is modified accordingly. In addition, a sharp change n the back EMF of the motor indicates that the ribbon is broken after the print head or the ribbon has stopped.

Tension on the supply side of the print nip must also be maintained. The ribbon is fed through a series of posts 416, 421, 422, 423, 424 and 425 (post 416 being the encoder roller which provides drag to the ribbon through the friction of the ribbon against the posts). A light clutch load is provided by the one way clutch 335 on the ribbon supply core to provide tighter wrap of the ribbon around the post. The ribbon encoder 341 is turned by the friction of the ribbon moving past the roller 416. The encoder motion is monitored by the microcontroller 30 to determine if the ribbon breaks before reaching the print head of if the ribbon runs out. In addition, the encoder can be used to monitor the speed of the ribbon, and therefore the envelope, through the print nip.

When printing has been completed, the shaft 83 rotates 180 degrees back to its original home position. The drive link 201 and 214 becomes a solid assembly which pushes the ejection roller 234 against the envelope 25. Since a lighter load is needed for ejection than for printing, the spring 227 becomes the only active spring. Again, flags 500 and 502 interrupt the optical sensor 506 to indicate 180 degrees of rotation. This 180 degree rotation engages the ejection roller and disengages the platen roller. During the rotation, the stop lever 122 and trip lever 89 are also released to extend above the feed deck. Due to their very light spring load, the lever will ride along the bottom of the envelope until it clears the platen roller.

The motor 44 continues to drive both rollers 230 and 234. At this point, however, the platen roller 230 becomes inactive because it is below the feed deck. At the same time, the ribbon motor 46 is stopped. When the ejection roller 234 engages, it feeds the envelope 25 from the printer at 2 to 3 times the print speed in the preferred. Once the envelope 25 clears the print nip, the stop and trip levers 120 and 89, respectively, return to their home position. The drive motor 44 is stopped and the process is complete.

The microcontroller issues position commands to the motor control. The motor controller reads the back EMF which is related to the torque load on the motor 44. The torque is determined as follows:

$$\text{Tension} = Kt * (Iavg - I_{AVG(TARE)}) * n * e * \text{radius (take-up diameter)}$$

Where

Ke—Back EMF constant (Volts/RPM)

Kt—Torque constant (in-oz/amp). Above supplied by motor manufacturer

Iavg—average current

Iavg(tare)—tare torque (average wasted current with no work performed)

n—gear ratio e—coefficient (reflect losses in gear train)

The radius of the take-up is determined by the BEMF of the base motor since the tangential speed of the take-up spool is the same as the selected paper speed, the radius can be readily determined from the known BEMF at that point.

The microcontroller is programmed such that upon initiation of the take-up motor at logic block 60 the PWM of the take-up motor is adjusted for the selected paper speed at 61. At logic block 62 a sample of the digitized back EMF provided from the motor controller is taken. The base motor speed is then determined at logic block 63. At logic block 64 and 65 the selected paper speed and generation of the base motor to the take-up spool are respectively supplied to logic block 66 whereat the radius of the take-up spool is either calculated or obtained from a memory resident look-up table. At this point the selected paper speed at logic block 76, Kt of the motor at logic block 67 and the tare torque at logic block 68 is provided to logic block 69 where the take-up motor torque is determined either utilizing a take-up table or by calculation. The microcontroller then issues a new command to the motor drive controller which results in adjustment of the PWM to the take-up motor at logic block 70. The routine then loops back to logic block 62.

The above description describes the preferred embodiment of the invention and should not be viewed as limiting. The scope of the invention is set forth in the appendix claims.

What is claimed is:

1. An improved thermal printing postage meter having a base supporting a registration wall and a deck, and having a thermal print head fixably mounted to said registration wall above a portion of said deck to define a print station, a thermal ribbon cassette detachably mounted to said registration wall, said thermal ribbon cassette having a thermal transfer ribbon supply mounted around a supply roller and threaded past said print head in said printing station to a take-up roller, for printing on an media traversing said print station wherein the improvement comprises:

a platen roller;

a platen roller assembly means for supporting said platen roller and for position said platen roller to assume a second positioned biasing said media against said thermal transfer ribbon and said thermal print head, and a home position ducked below said deck;

first motor drive means for rotatively driving said platen roller, wherein rotation of said platen roller simultaneously drives said media and thermal transfer ribbon past said print head;

second motor drive means for driving said take-up roller during a print cycle;

a microcontroller means in communication with said first motor drive means and said second motor drive means for driving said first and second motor drive means at complementary speeds whereby the web tension of said thermal transfer ribbon remains constant.

2. An improved thermal printing postage meter as claimed in claim 1 wherein said microcontroller means comprises a microcontroller in bus communication with a motor controller which motor controller is in bus communication with first and second motor drive means, wherein said microcontroller is programmed to issue position commands for said first and second motor drive means to said motor controller, said motor controller to generate respective PWM signals in response to said position commands, and communicate said respective PWM signals to a motor amplifier for gating power to said respective motors in response to said PWM signal generated, said first and second drive means to generate respectively a back EMF in response to gated power to said respective first and second drive means, said motor controller having means for determining the back EMF for the respective first and second drive motor means and comparing said back EMF of said first drive motor means to said back EMF of said second drive motor means such that:

BEMF (First Motor)=K*BEMF (Second Motor)+Delta

Where is Delta is greater than a predetermined amount said PWM signals for second said drive motor means is incrementally modified and recompared to said back EMF of said first drive motor means.

3. An improved thermal printing postage meter as claimed in claims 1 or 2 wherein said media is a mail envelope.

* * * * *